US010006282B2

(12) United States Patent
Livescu et al.

(10) Patent No.: US 10,006,282 B2
(45) Date of Patent: Jun. 26, 2018

(54) SYSTEMS AND METHODS FOR OPERATING ELECTRICALLY-ACTUATED COILED TUBING TOOLS AND SENSORS

(71) Applicant: Baker Hughes Incorporated, Houston, TX (US)

(72) Inventors: Silviu Livescu, Calgary (CA); Thomas J. Watkins, Calgary (CA); Steven Craig, Spring, TX (US); Luis Castro, The Woodlands, TX (US)

(73) Assignee: BAKER HUGHES, A GE COMPANY, LLC

( * ) Notice: Subject to any disclaimer, the term of this patent is extended or adjusted under 35 U.S.C. 154(b) by 301 days.

(21) Appl. No.: 14/969,007

(22) Filed: Dec. 15, 2015

(65) Prior Publication Data

US 2016/0186501 A1 Jun. 30, 2016

Related U.S. Application Data

(60) Provisional application No. 62/091,772, filed on Dec. 15, 2014.

(51) Int. Cl.

| | |
|---|---|
| ***E21B 47/06*** | (2012.01) |
| ***E21B 47/00*** | (2012.01) |
| ***E21B 47/12*** | (2012.01) |
| ***E21B 34/14*** | (2006.01) |
| ***E21B 17/20*** | (2006.01) |
| ***E21B 34/00*** | (2006.01) |

(52) U.S. Cl.

CPC ..... *E21B 47/065* (2013.01); *E21B 17/206* (2013.01); *E21B 34/14* (2013.01); *E21B 47/0002* (2013.01); *E21B 47/12* (2013.01); *E21B 2034/007* (2013.01)

(58) Field of Classification Search

CPC .... E21B 47/065; E21B 47/0002; E21B 47/12; E21B 17/206; E21B 34/14; E21B 2034/007; E21B 17/20; E21B 17/003; E21B 34/066; E21B 47/00; E21B 49/00

See application file for complete search history.

(56) References Cited

U.S. PATENT DOCUMENTS

| | | | | |
|---|---|---|---|---|
| 2005/0263281 | A1* | 12/2005 | Lovell | E21B 17/206 166/255.1 |
| 2007/0045006 | A1 | 3/2007 | Krueger et al. | |
| 2009/0266544 | A1 | 10/2009 | Redlinger et al. | |
| 2015/0075783 | A1* | 3/2015 | Angman | E21B 43/26 166/250.01 |

* cited by examiner

*Primary Examiner* — Wei Wang
(74) *Attorney, Agent, or Firm* — Shawn Hunter

(57) ABSTRACT

Electrically-operated downhole tools are run into a wellbore on a coiled tubing string which includes tube-wire that is capable of carrying power and data along its length. During operation, a downhole tool is provided power from surface using the tube-wire. Downhole data is provided to the surface via tube-wire.

10 Claims, 4 Drawing Sheets

SYSTEMS AND METHODS FOR OPERATING ELECTRICALLY-ACTUATED COILED TUBING TOOLS AND SENSORS

BACKGROUND OF THE INVENTION

1. Field of the Invention

The invention relates generally to devices and methods for providing power and/or data to downhole devices that are run in on coiled tubing.

2. Description of the Related Art

Tube-wire is a tube that contains an insulated cable that is used to provide electrical power and/or data to a bottom hole assembly (BHA) or to transmit data from the BHA to the surface. Tube-wire is available commercially from manufacturers such as Canada Tech Corporation of Calgary, Canada.

SUMMARY OF THE INVENTION

The invention provides systems and methods for providing electrical power to electrically-actuated downhole devices. In other aspects, the invention provides systems and methods for transmitting data or information to or from downhole devices, such as sensors. The embodiments of the present invention feature the use of Telecoil® to transmit power and or data downhole to tools or devices and/or to obtain real-time data or information from downhole devices or tools. Telecoil® is coiled tubing which incorporates tube-wire that can transmit power and data. In accordance with the present invention, Telecoil® running strings along with associated sensors (including cameras) and electrically-actuated tools can be used with a large variety of well intervention operations, such as cleanouts, milling, fracturing and logging. Combinations of electrically-actuated tools and sensors could be run at once, thereby providing for robust and reliable tool actuation.

In a described embodiment, a bottom hole assembly is incorporated into a coiled tubing string and is used to operate one or more sliding sleeve devices within a downhole tubular. The coiled tubing string is a Telecoil® tubing string which includes a tube-wire that is capable of transmitting power and data. The bottom hole assembly preferably includes a housing from which one or more arms can be selectively extended and retracted upon command from surface. Additionally, the bottom hole assembly preferably also includes a downhole camera which permits an operator at surface to visually determine whether a sliding sleeve device is open or closed. This embodiment has particular use with fracturing arrangements having sliding sleeves as there is currently no acceptable means of determining whether a fracturing sleeve is open or closed.

According to another aspect, arrangement incorporates a distributed temperature sensing (DTS) arrangement which monitors temperature at a number of points along a wellbore. The present invention features the use of tube-wire and Telecoil® to provide power from surface to downhole devices and allow data from downhole devices to be provided to the surface in real time.

In a second described embodiment, the electrically-actuated tool is in the form of a fluid hammer tool which is employed to interrogate or examine a fractured portion of a wellbore. One or more pressure sensors are associated with the fluid hammer tool and will detect pressure pulses which are generated by the fluid hammer tool as well as pulses which are reflected back toward the fluid hammer tool from the fractured portion of the wellbore.

BRIEF DESCRIPTION OF THE DRAWINGS

The advantages and further aspects of the invention will be readily appreciated by those of ordinary skill in the art as the same becomes better understood by reference to the following detailed description when considered in conjunction with the accompanying drawings in which like reference characters designate like or similar elements throughout the several figures of the drawing and wherein.

DETAILED DESCRIPTION OF THE PREFERRED EMBODIMENTS

Figure 1:
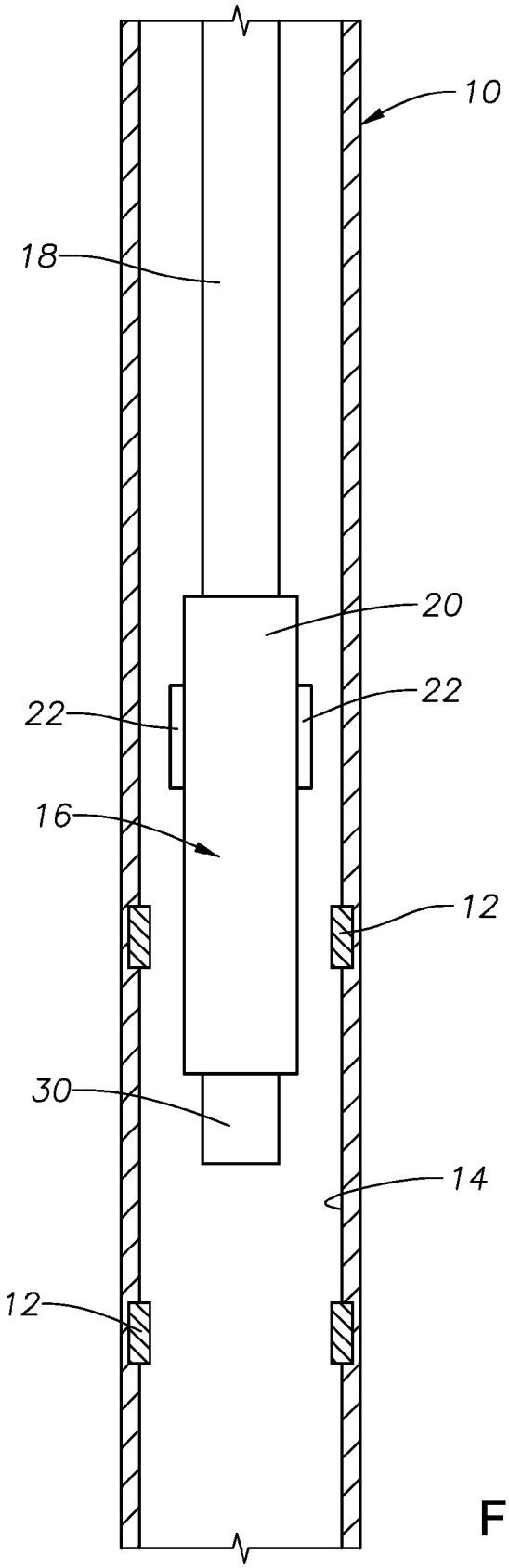
FIG. 1 is a side, cross-sectional view of a portion of an exemplary wellbore tubular having sliding sleeve devices therein and a coiled tubing device for operating the sleeves.
Figure 1A:
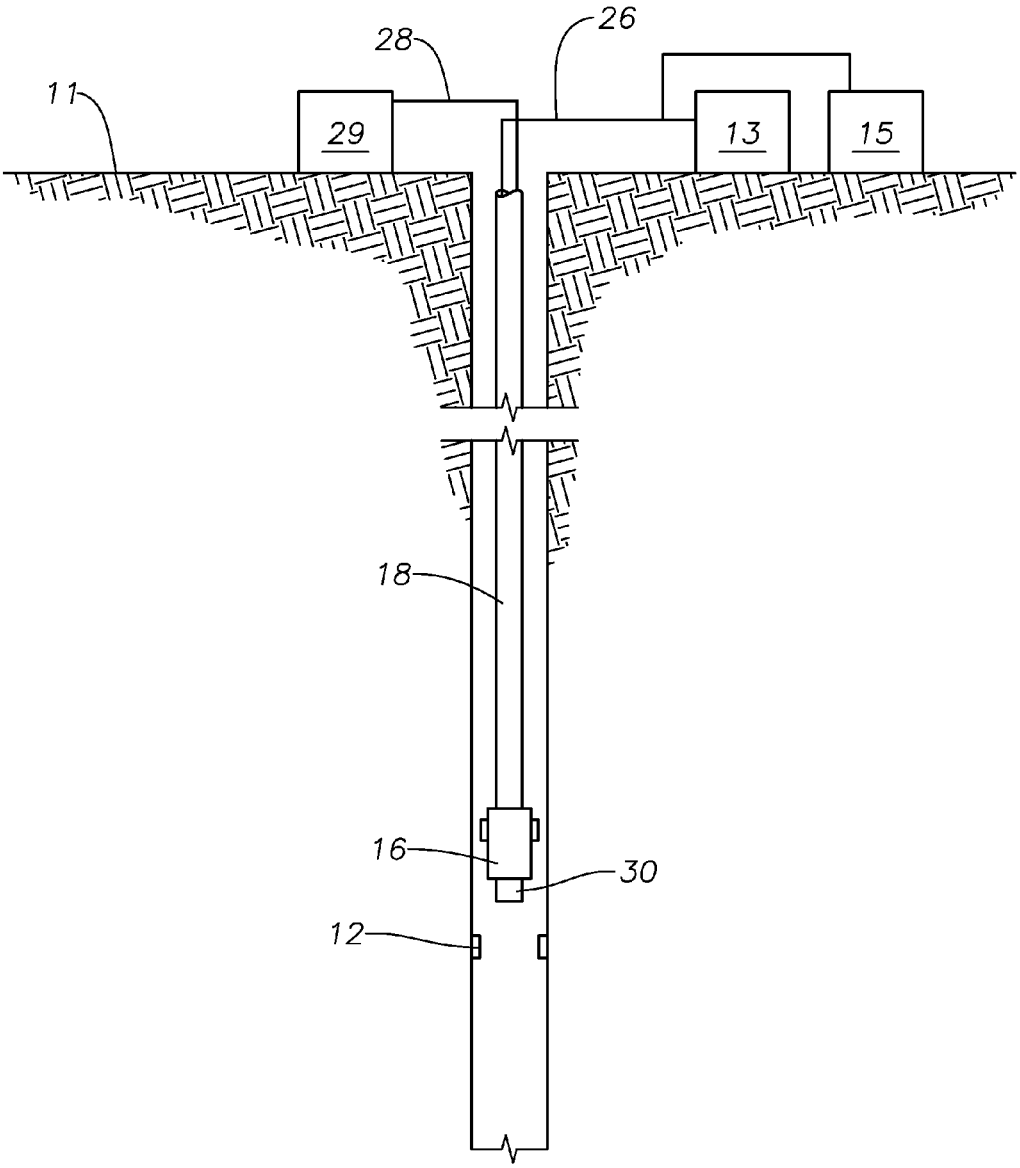
FIG. 1A is a cross-sectional view of the wellbore of FIG. 1, further illustrating surface-based components.

FIG. 1 depicts an exemplary wellbore tubular 10. In a preferred embodiment, the tubular 10 is wellbore casing. Alternatively, the wellbore tubular 10 might be a section of wellbore production tubing. The wellbore tubular 10 includes a plurality of sliding sleeve devices, shown schematically at 12. The wellbore tubular 10 defines a central flowbore 14 along its length. The sliding sleeve devices 12 may be sliding sleeve valves, of a type known in the art, that are moveable between open and closed positions as a sleeve member is axially moved. FIG. 1A further illustrates related components at the surface 11 of the wellbore 10. A controller 13 and power source 15 are located at surface 11. Those of skill in the art will understand that other system components and devices, including for example, a coiled tubing injector which is used to inject a coiled tubing running string into the wellbore 10. The controller 13 preferably includes a computer or other programmable processor device which is suitably programmed to receive temperature data as well as visual image data from a downhole camera. The power source 15 is an electrical power source, such as a generator.

Figure 2:
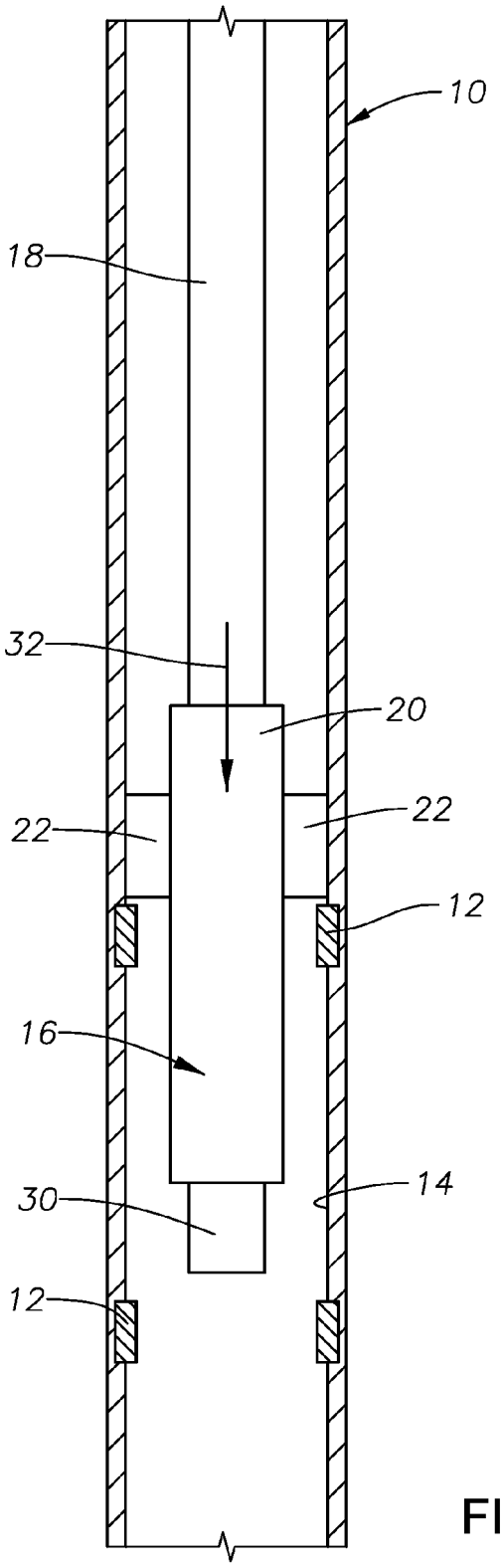
FIG. 2 is a side, cross-sectional view of the arrangement shown in FIG. 1, now with the coiled tubing device having been actuated to manipulate a sliding sleeve device.

A bottom hole assembly 16 is shown disposed into the flowbore 14 by a coiled tubing running string 18. The bottom hole assembly 16 includes an outer sub housing 20 that is secured to the coiled tubing running string 18. The housing 20 encloses an electrically-actuated motor, of a type known in the art, which is operable to radially extend arms 22 radially outwardly or inwardly with respect to the housing 20 upon actuation from the surface. Arms 22 are shown schematically in FIGS. 1-2. In practice, however, the arms 22 have latching collets or other engagement portions that are designed to engage a complimentary portion of a sliding sleeve device 12 sleeve so that it can be axially moved between open and closed positions.

Figure 3:
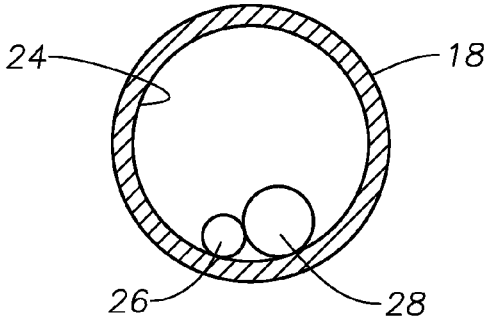
FIG. 3 is an axial cross-sectional view of coiled tubing used in the arrangements shown in FIGS. 1-2.

The coiled tubing running string 18 is a Telecoil® running string. FIG. 3 is an axial cross-section of the coiled tubing running string 18 which reveals that the running string 18 defines a central axial bore 24 along its length. Tube-wire 26 extends along the coiled tubing string 18 within the flowbore 24. The tubewire 26 extends from controller 13 and power source 15 at the surface 11 to the bottom hole assembly 16.

In addition, a distributed temperature sensing (DTS) fiber 28 extends along the coiled tubing string 18 within the flowbore 24. The DTS fiber is an optic fiber that includes a plurality of temperature sensors along its length for the purpose of detecting temperature at a number of discrete points along the fiber. Preferably, the DTS fiber 28 is operably interconnected with an optical time-domain reflectometer (OTDR) 29 (in FIG. 1A) of a type known in the art, which is capable of transmitting optical pulses into the fiber optic cable and analyzing the light that is returned, reflected or scattered therein.

A downhole camera 30 is also preferably incorporated into the bottom hole assembly 16. The camera 30 is capable of obtaining visual images of the flowbore 14 and, in particular, is capable of obtaining images of the sliding sleeve devices 12 in sufficient detail to permit a viewer to determine whether a sleeve device 12 is in an open or closed position. The camera 30 is operably associated with the tube-wire 26 so that image data can be transmitted to the surface 11 for display to an operator in real time. In accordance with alternative embodiments, the camera 30 is replaced with (or supplemented by) one or more magnetic or electrical sensors that is useful for determining the open or closed position of the sliding sleeve device(s) 12. Such sensor(s) are operably associated with the tube-wire 26 so that data detected by the sensor(s) is transmitted to surface in real time.

In operation, the bottom hole assembly 16 is disposed into the wellbore tubular 10 on coiled tubing running string 18. The bottom hole assembly 16 is moved within the flowbore 14 until it is proximate a sliding sleeve device 12 which has been selected to actuate by moving it between open and closed positions (see FIG. 1). A casing collar locator (not shown) of a type known in the art may be used to help align the bottom hole assembly 16 with a desired sliding sleeve device 12. Then, a command is transmitted from the surface via tube-wire 26 to cause one or more arms 22 to extend radially outwardly from the housing 20 (see FIG. 2). Arms 22 may be in the form of bumps or hooks that are shaped and sized to engage a complementary portion of the sleeve of the sliding sleeve device. The bottom hole assembly 16 is then moved in direction of arrow 32 in FIG. 2 to cause the sliding sleeve device 12 to be moved between open and closed positions. Thereafter, the arms 22 are retracted in response to a command from surface. The bottom hole assembly 16 may then be moved proximate another sliding sleeve device 12 or withdrawn from the wellbore tubular 10. During operation, the camera 30 provides real time visual images to an operator at surface to allow the operator to visually ensure that the sliding sleeve device 12 has been opened or closed as intended. Temperature can be monitored during operation using the DTS fiber 28. The DTS fiber 28 operates as a multi-point sensor (i.e., the entire fiber is the sensor) and can provide the temperature profile along the length of the coiled tubing running string 18, including the bottom hole assembly 16. The temperature data obtained can be combined with other data obtained from the bottom hole assembly 16, such as pressure, temperature, flow rates, etc.

Telecoil® and tube-wire can be used to provide power downhole and send real-time downhole data to the surface in numerous instances. Any of a number of electrically-actuated downhole tools can be operated using tube-wire. For example, logging tools that include DTS systems can be run in on Telecoil® rather than using batteries for power. Electric power needed for a Telecoil® system or a coiled tubing system can be supplied from surface. Real time downhole data, such as temperature, pressure, gamma, location and so forth can be transmitted to surface via tube-wire.

Figure 4:
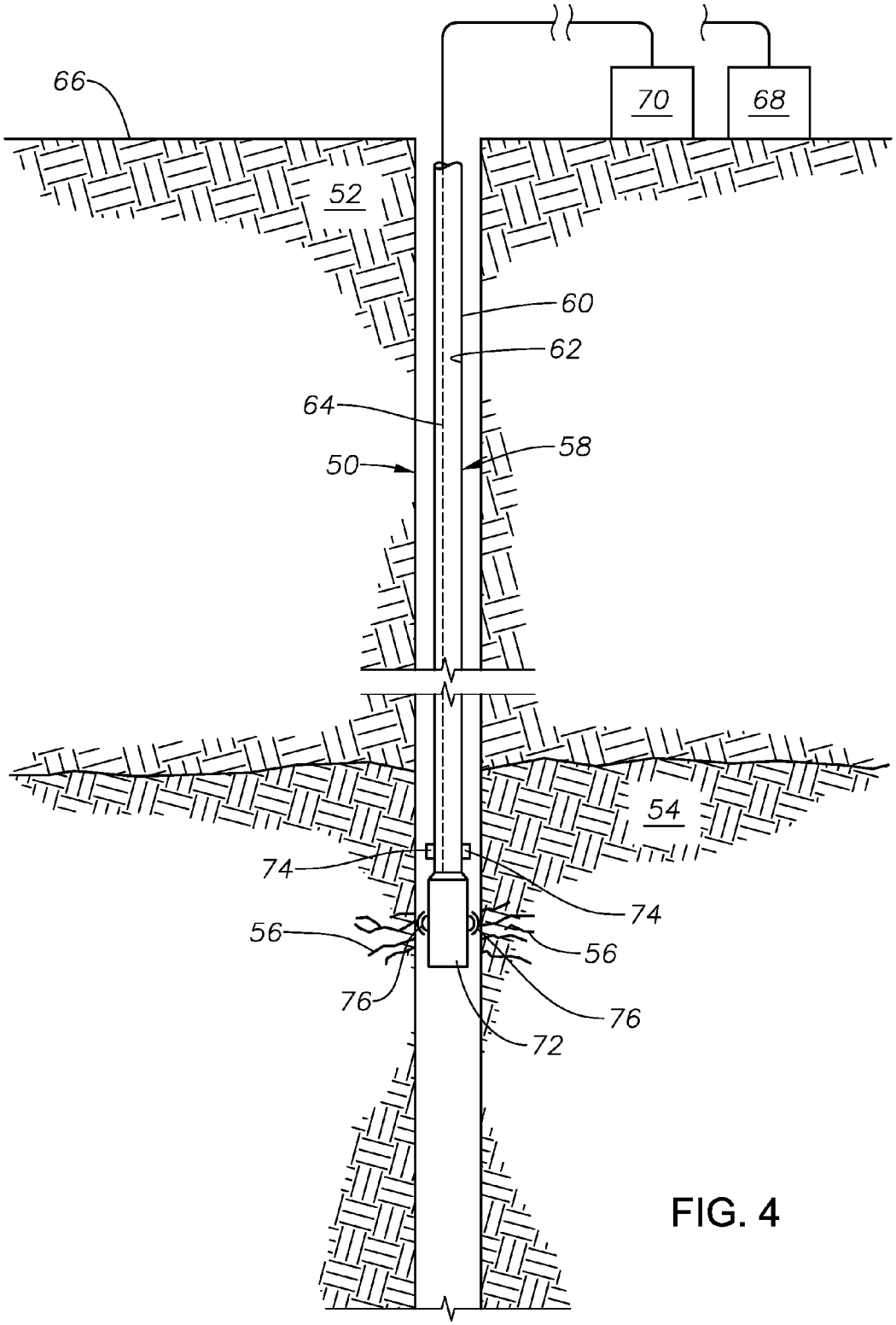
FIG. 4 is a side, cross-sectional view of wellbore which contains a fracture interrogation system in accordance with the present invention.

According to another aspect of the invention, the electrically-actuated tool takes the form of a fluid hammer tool which uses pressure pulses to interrogate a fracture in a wellbore for the purpose of evaluating its properties (i.e., length, aperture, size, etc.). Fluid hammer tools are known devices which are typically incorporated into drilling strings to help prevent sticking of the drill bit during operation. Fluid hammer tools of this type generate fluid pulses within a surrounding wellbore. FIG. 4 depicts a wellbore 50 that has been drilled through the earth 52 down to a formation 54. Fractures 56 have previously been created in the formation 54 surrounding the wellbore 50.

A fracture interrogation tool system 58 is disposed within the wellbore tubular 50 and includes a Telecoil® coiled tubing running string 60 which defines a central flowbore 62 which contains tube-wire 64. The tube-wire 64 is interconnected at surface 66 with an electrical power source 68 and a controller 70. The controller 70 preferably includes a computer or other programmable processor device which is suitably programmed to receive pressure data relating to fluid pulses generated within the wellbore 50. The controller 70 should preferably be capable of displaying received data to a user at the surface 66 and/or storing such information within memory. A fluid hammer tool 72 is carried at the distal end of the coiled tubing running string 60. Pressure sensors 74 are operably associated with the running string 60 proximate the fluid hammer tool 72. Tubewire 64 is preferably used to provide power to the fluid hammer tool 72 from power source 68 at surface 66. In addition, tubewire 64 is used to transmit data from pressure sensors 74 to the controller 70.

In exemplary operation for the fracture interrogation system 50, the fluid hammer tool 72 is run in on a Telecoil coiled tubing running string 60 and located proximate fractures 56 to be interrogated. Pressure pulses 76 are generated by the fluid hammer tool 72, travel through the fractures 56, impact the fracture walls and travel back toward the tool 72. The difference between initial and reflected pressure pulses is used to evaluate the fracture properties. Pressure sensors 74 associated with the fluid hammer tool 72 detect the initial and reflected pulses and transmit this data to surface in real time via tubewire 64 within the Telecoil® running string 60. Instead of having a fluid flow activated fluid hammer tool with its inherent limitations, an electrically-actuated fluid hammer tool 72 could help reduce the static coefficient of friction at the beginning of the bottom hole assembly movement between stages. By reducing the coefficient of friction instantly from a static to a dynamic regime, less or no lubricant would be needed for moving the bottom hole assembly between stages and having enough bottom hole assembly force. An electrically operated tool could have the ability to acquire real-time downhole parameters such as pressure, temperature and so forth during operation.

Telecoil® can also be used to provide power to and obtain downhole data from a number of other downhole tools. Examples include a wellbore clean out tool or electrical tornado.

It can be seen that the invention provides downhole tool systems that incorporate Telecoil® style coiled tubing running strings which carry an electrically-actuated downhole tool. These downhole tool systems also preferably include at least one sensor that is capable of detecting a downhole parameter (i.e., temperature, pressure, visual image, etc.) and transmitting a signal representative of the detected parameter to surface via tube-wire within the running string. According to a first described embodiment, the electrically-actuated downhole tool is a device for actuating a downhole sliding sleeve device. In a second described embodiment, the electrically-actuated downhole tool is a fluid hammer tool which is effective to create fluid pulses. It should also be seen that the downhole tools systems of the present invention include one or more sensors which are associated with the downhole tool and that these sensors can be in the form of pressure sensors, temperature sensors or a camera. Data from these sensors can be transmitted to surface via the Telecoil® style coiled tubing running string.

It can also be seen that the invention provides methods for operating an electrically-actuated downhole tool wherein an electrically-actuated downhole tool is secured to a Telecoil® coiled tubing running string and disposed into a wellbore tubular. The wellbore tubular may be in the form of a cased wellbore 10 or uncased wellbore 50. The electrically-actuated downhole tool is then disposed into the wellbore tubular on the running string. Electrical power is provided to the downhole tool from a power source at surface via tube-wire within the running string. Data is sent to surface from one or more sensors that are associated with the downhole tool.

The foregoing description is directed to particular embodiments of the present invention for the purpose of illustration and explanation. It will be apparent, however, to one skilled in the art that many modifications and changes to the embodiment set forth above are possible without departing from the scope and the spirit of the invention.

What is claimed is:

1. A downhole tool system for performing a function within a wellbore tubular, the system comprising:

an electrically-actuatable downhole tool within a bottom hole assembly;

a coiled tubing running string secured to the bottom hole assembly to dispose the downhole tool into the wellbore tubular;

a tube-wire within the coiled tubing running string and operably interconnected with the downhole tool, the tube-wire being capable of carrying electrical power and data along its length to or from the downhole tool; and wherein the downhole tool comprises a housing with one or more arms which selectively extend outwardly from the housing in response to a command transmitted via the tube-wire, and the arms being operable to move a sliding sleeve device within the wellbore tubular between open and closed positions by movement of the bottom hole assembly within the wellbore.

2. The downhole tool system of claim 1 further comprising a camera operably associated with the downhole tool to obtain one or more visual images of the wellbore tubular and transmit said image data to surface via the tube-wire.

3. The downhole tool system of claim 1 further comprising a fiber optic distributed sensor contained within the coiled tubing running string to detect an operational parameter within the wellbore tubular.

4. The downhole tool system of claim 3 wherein the fiber optic distributed sensor comprises a temperature sensor.

5. A downhole tool system for performing a function within a wellbore tubular, the system comprising:

an electrically-actuatable downhole tool;

a coiled tubing running string secured to the downhole tool to dispose the downhole tool into the wellbore tubular;

a tube-wire within the coiled tubing running string and operably interconnected with the downhole tool, the tube-wire being capable of carrying electrical power and data along its length to or from the downhole tool;

a power source operably associated with the tube-wire to provide operating power to the electrically-actuated downhole tool via the tube-wire; and wherein the downhole tool comprises a housing with one or more arms which selectively extend outwardly from the housing in response to a command transmitted via the tube-wire, and the arms being operable to move a sliding sleeve device within the wellbore tubular between open and closed positions by movement of the bottom hole assembly within the wellbore.

6. The downhole tool system of claim 5 further comprising:

a sensor operably associated with the downhole tool to sense a downhole parameter within the wellbore tubular and transmit a signal representative of the sensed parameter via the coiled tubing running string.

7. The downhole tool system of claim 5 further comprising a camera operably associated with the downhole tool to obtain one or more visual images of the wellbore tubular and transmit said image data to surface via the tube-wire.

8. The downhole tool system of claim 5 further comprising a fiber optic distributed sensor contained within the coiled tubing running string to detect an operational parameter within the wellbore tubular.

9. The downhole tool system of claim 8 wherein the fiber optic distributed sensor comprises a temperature sensor.

10. A method for operating an electrically-actuated downhole tool within a wellbore, the method comprising the steps of:

securing the electrically-actuated downhole tool to a running string, the running string comprising a coiled tubing string defining a flowbore within and a tube-wire disposed along the flowbore and the electrically-actuated downhole tool being contained within a bottom hole assembly and comprising a housing with one or more arms which selectively extend outwardly from the housing in response to a command transmitted via the tube-wire, and the arms being operable to move a sliding sleeve device within the wellbore tubular between open and closed positions;

disposing the electrically-actuated downhole tool into a wellbore from surface on the running string;

providing electrical power to the electrically-actuated downhole tool from surface via the tube-wire;

obtaining data at surface from a sensor that is operably associated with the electrically-actuated downhole tool via the tube-wire; and shifting the sliding sleeve device within the flowbore between open and closed positions by movement of the bottom hole assembly within the wellbore.

* * * * *